US006971959B1

(12) United States Patent
Lu

(10) Patent No.: US 6,971,959 B1
(45) Date of Patent: Dec. 6, 2005

(54) GRIP FOR SPORTS EQUIPMENT

(76) Inventor: Clive S. Lu, 282 Newbridge Rd., Hicksville, NY (US) 11801

( * ) Notice: Subject to any disclaimer, the term of this patent is extended or adjusted under 35 U.S.C. 154(b) by 0 days.

(21) Appl. No.: 10/752,077

(22) Filed: Jan. 6, 2004

(51) Int. Cl.[7] ..... A63B 53/14
(52) U.S. Cl. ..... 473/302; 473/549
(58) Field of Search ..... 473/300–303, 473/549, 568; D21/756; 74/551.9; 81/489, 81/492; 16/421; 280/821

(56) References Cited

U.S. PATENT DOCUMENTS

| | | | | | |
|---|---|---|---|---|---|
| 979,266 | A | * | 12/1910 | Dean | 473/568 |
| 1,902,438 | A | | 3/1933 | Foley | |
| 2,768,457 | A | | 10/1956 | Biek | |
| 3,140,873 | A | * | 7/1964 | Goodwin | 473/302 |
| 3,567,237 | A | | 3/1971 | Miller, III | |
| 3,965,590 | A | | 6/1976 | Algaze | |
| 4,195,837 | A | | 4/1980 | Poulin | |
| 4,600,195 | A | | 7/1986 | Hunter | |
| 4,733,629 | A | * | 3/1988 | Hunt et al. | 114/357 |
| 4,858,925 | A | | 8/1989 | DeStefano, Jr. | |
| 5,364,677 | A | * | 11/1994 | Sendziak | 428/40.1 |
| 5,570,541 | A | | 11/1996 | Hering | |
| 5,711,720 | A | | 1/1998 | Janes et al. | |
| 5,846,629 | A | * | 12/1998 | Gwinn | 428/68 |
| 5,890,308 | A | | 4/1999 | Harrington | |
| 6,042,484 | A | | 3/2000 | Streit | |
| 6,122,802 | A | | 9/2000 | Lo | |
| 6,287,221 | B1 | | 9/2001 | Pino | |
| 6,314,598 | B1 | | 11/2001 | Yates | |
| 2001/0039215 | A1 | | 11/2001 | Buchanan | |

* cited by examiner

*Primary Examiner*—Stephen Blau
(74) *Attorney, Agent, or Firm*—King & Schickli, PLLC

(57) ABSTRACT

A grip for sporting equipment is provided having an elongated strip adapted for wrapping the gripping end of the equipment and a locking mechanism. The locking mechanism includes locking structures, typically ribs and grooves disposed on the elongated strip side edges. Wrapping the elongated strip around the gripping end places the adjoining first and second locking structures in a partially overlapped and facing orientation for cooperative interlocking thereof to secure the adjoining side edges, defining a hollow sleeve adapted to receive the gripping end in an interior thereof.

8 Claims, 4 Drawing Sheets

GRIP FOR SPORTS EQUIPMENT

FIELD OF THE INVENTION

This invention relates generally to the field of grips for articles of sporting equipment having a gripping end, such as golf clubs and tennis rackets. In particular, the present invention relates to a strip or ribbon-style grip for sporting equipment providing enhanced retention and reduced slippage.

BACKGROUND OF THE INVENTION

The grip provided on most sporting equipment having a gripping end, such as golf clubs, tennis rackets, and the like, provides cushioning and reduces slippage of the user's hands, thereby improving the user's enjoyment of the sport of choice. It is known to provide a grip for such sporting equipment which may comprise a hollow sleeve, which may be slipped or rolled onto the gripping end. Similarly, strip or ribbon-style grips are known in the art, which may be spirally wrapped around the gripping end of sporting equipment to provide the desired cushioned, reduced slippage surface for gripping.

Typically, a grip such as a strip or ribbon-style grip is secured to an article of sporting equipment using any of a number of adhesives well known in the art. The installer may apply the adhesive to the gripping end or to the strip, or the strip may be purchased with an adhesive substance already on the surface which contacts the gripping end. The installer then simply winds the strip helically around the gripping end, typically partially overlapping adjacent sides of the strip, to adhere the grip to the equipment and provide a secure gripping surface.

Use of such an adhesive provides a strong, generally water-resistant bond between grip and equipment. However, over time and with use, conventional adhesives tend to weaken. Particularly in the case of a strip or ribbon-style grip, weakening of the adhesive results in loosening of the contact between the adjacent strip sides, and unraveling of the strip or ribbon. The user must then either have the original grip removed and refitted using fresh adhesive, or purchase a new grip for installation.

Accordingly, there is a need in the art for a means for reducing the incidence of loosening and/or unraveling of a strip or ribbon-style grip for sporting equipment. The present invention provides such a means, without interfering with the primary function of providing a secure gripping area for the sporting equipment user.

SUMMARY OF THE INVENTION

In one aspect, the present invention provides a grip for sporting equipment having a gripping end, comprising an elongated strip adapted for wrapping the gripping end and a locking mechanism disposed on the elongated strip. Wrapping the elongated strip around the gripping end whereby adjoining strip sections are in abutment allows cooperative interlocking of the locking mechanism such that the elongated strip defines a hollow sleeve adapted to receive the gripping end in an interior thereof. Typically, the locking mechanism will be a rib and groove structure of a type known in the art.

In another aspect, the present invention provides a grip for sporting equipment having a gripping end, comprising an elongated strip adapted for wrapping the gripping end. The elongated strip includes a first edge, a second edge, a top edge, and a bottom edge. A first cooperating locking structure may be disposed on the first edge, and a second cooperating locking structure may be disposed on the second edge. Wrapping the elongated strip around the gripping end such that the adjoining strip edges are in abutment at least partially overlaps the first and second locking structures for cooperative interlocking thereof to secure the first edge to the second edge of adjoining strip sections. In this fashion, a hollow sleeve is defined which is adapted to receive the gripping end securely in an interior thereof.

Typically, the first locking structure is a rib and groove structure disposed on the elongated strip first edge and the second locking structure is a rib and groove structure disposed on the elongated strip second edge. The elongated strip first edge is typically substantially parallel to the second edge. The elongated strip top edge and bottom edge may terminate in a bevel, allowing a more flush mounting of the top and bottom edges of the strip to the gripping end.

In yet another aspect of the present invention, a grip for sporting equipment having a gripping end is provided, comprising an elongated strip adapted for wrapping the gripping end. The strip includes a top edge, a bottom edge, first and second side edges, a top face, and a bottom face which is opposed to the top face. A first locking structure may be disposed on the first side edge, oriented towards the bottom face. A second locking structure may be disposed on the second side edge, oriented towards the top face. Accordingly, properly wrapping the elongated strip around the gripping end places the first and second locking structures on adjoining strip sections in a partially overlapped and facing orientation for cooperative interlocking thereof to secure the first side edge to the second side edge. A hollow sleeve is thus defined which is adapted to receive the gripping end in an interior thereof.

As described above, the locking structures may be ribs and grooves disposed on the elongated strip first and second side edges. In a preferred embodiment, the first locking structure is a rib and groove structure extending downwardly from the elongated strip bottom face, and the second locking structure is a cooperating rib and groove structure extending upwardly from the elongated strip top face. Typically, the strip first side edge is substantially parallel to the second side edge. The strip top edge and bottom edge may terminate in a bevel. Similarly, the elongated strip top face side edges may be beveled. It will be appreciated that this feature, when the gripping end is wrapped with the elongated strip, defines a groove between adjacent side edges which allows airflow and moisture channeling between the user's palm and the grip of the present invention, improving comfort.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawings incorporated in and forming a part of the specification illustrate several aspects of the present invention and, together with the description, serve to explain the principles of the invention. In the drawings.

Reference will now be made in detail to the presently preferred embodiment of the invention, an example of which is illustrated in the accompanying drawings.

DETAILED DESCRIPTION OF THE INVENTION

In accordance with the need identified in the foregoing description, the present invention provides a grip 10 for sporting equipment having a gripping end 14, comprising an elongated strip 12 adapted for wrapping the gripping end 14 and a locking mechanism 16 disposed on the elongated strip 12. Properly wrapping the elongated strip 12 around the gripping end 14 such that adjoining side edges of strip 12 are in abutment allows cooperative interlocking of the locking mechanism 16 whereby the elongated strip 12 defines a hollow sleeve adapted to receive the gripping end 14 in an interior thereof.

Figure 1:
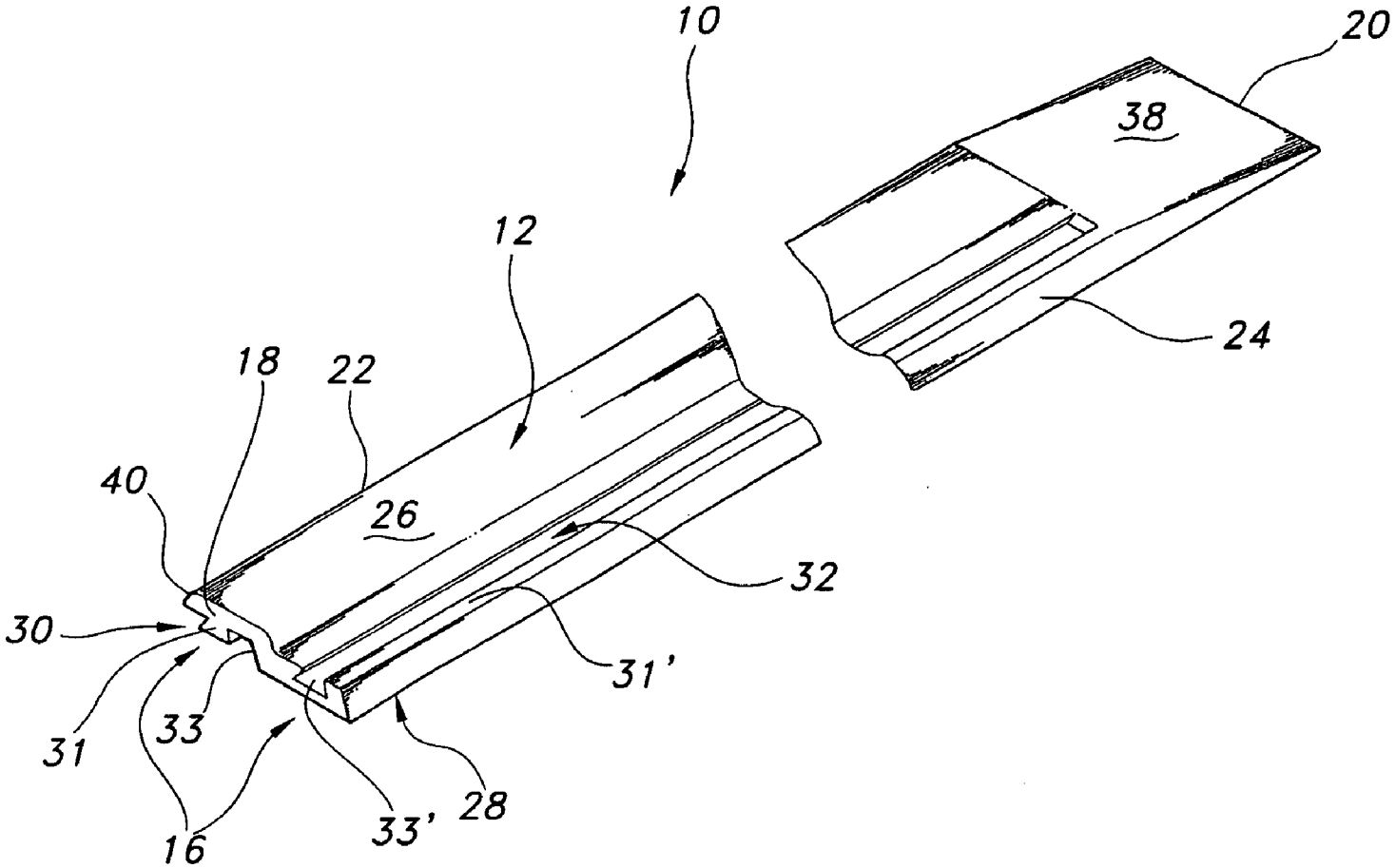
FIG. 1 is a perspective view of the elongated strip of the present invention.

Referring to FIG. 1, the elongated strip 12 includes a top edge 18, a bottom edge 20, first and second side edges 22, 24, a top face 26, and a bottom face 28 which is opposed to the top face 26. A first locking structure 30 may be disposed on the first side edge 22. Similarly, a second locking structure 32 may be disposed on the second side edge 24. Wrapping the elongated strip 12 around the gripping end 14 places the adjoining first and second locking structures 30, 32 in a partially overlapped and facing orientation for cooperative interlocking thereof to secure adjoining first side edges 22 to second side edges 24. A hollow sleeve is thus defined which is adapted to receive the gripping end 14 in an interior thereof.

The locking structures are typically ribs and grooves disposed on the elongated strip first and second side edges 22, 24. In one embodiment, the first locking structure 30 is a rib 31 and a groove 33 extending downwardly from the elongated strip bottom face 28, and the second locking structure 32 is a cooperating rib 31' and groove 33' defined in the elongated strip top face 26. However, it will be appreciated that other structures are anticipated by the locking structures of the present invention. Typically, the strip first side edge 22 is substantially parallel to the second side edge 24. The strip bottom edge 20 may terminate in a bevel 38. Similarly, the edges of elongated strip top face 26 may include bevels 40, 40'.

Figure 2:
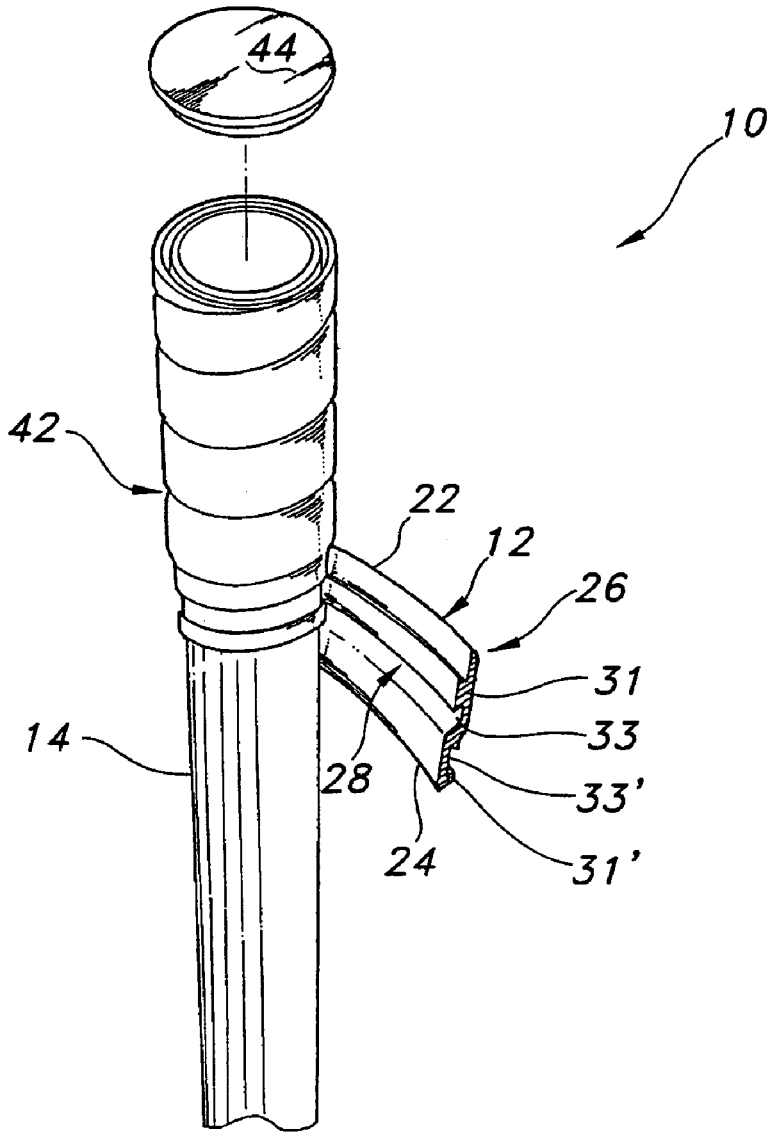
FIG. 2 illustrates the grip of FIG. 1 being wrapped around a gripping end of a golf club.
Figure 3:
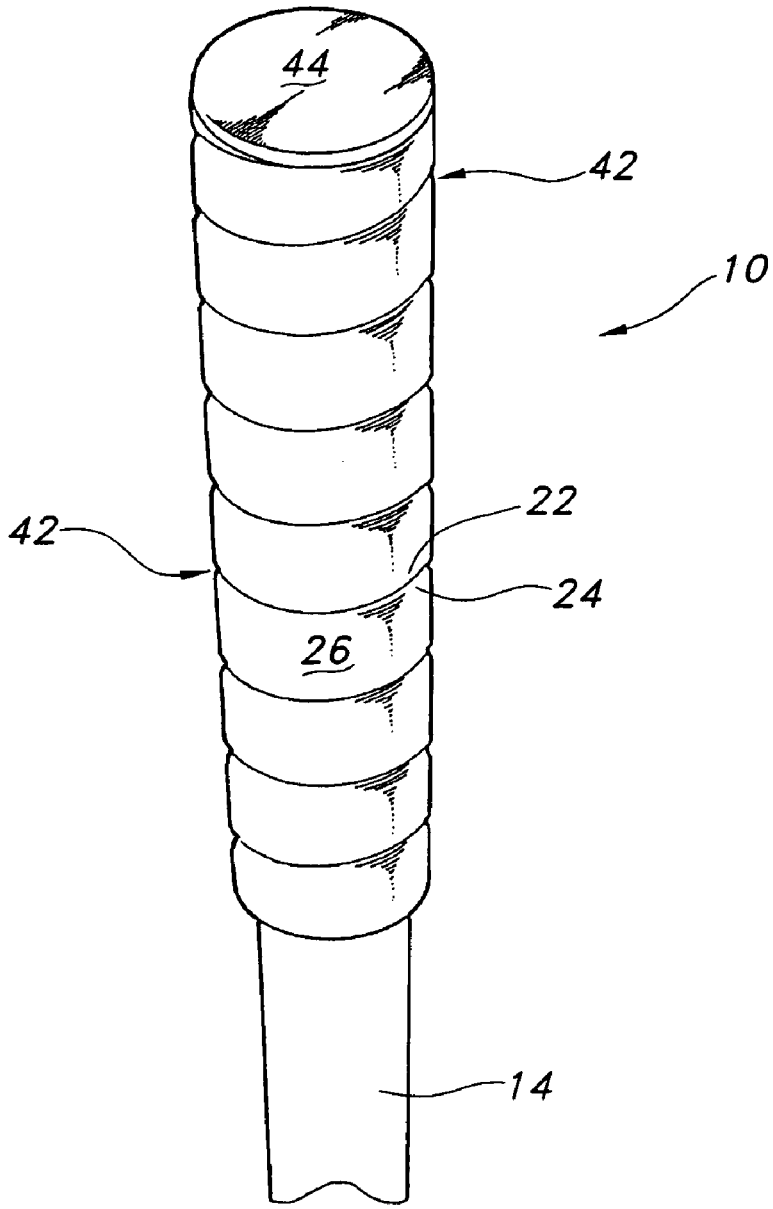
FIG. 3 shows the grip of FIG. 1 fully installed on a gripping end of a golf club.
Figure 4:
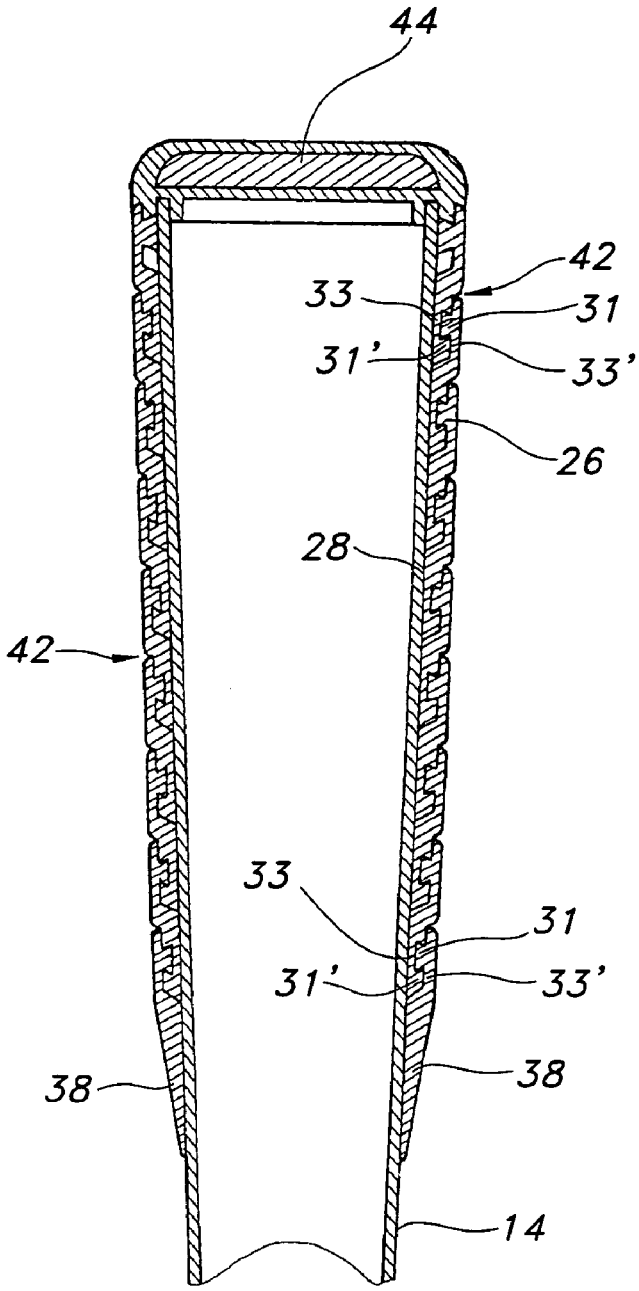
FIG. 4 is cross-sectional view of the installed grip of FIG. 3.

Referring to FIGS. 2–4, in use a suitable adhesive may be coated onto an outer surface of gripping end 14. Alternatively, the adhesive may be coated onto the elongated strip 12, or onto both surfaces. Still further, the elongated strip 12 may be pre-coated with the adhesive during manufacture. Numerous suitable adhesive substances are known in the art. The elongated strip 12 is then wrapped helically around the gripping end 14 (FIG. 2). As the strip 12 is wrapped, side edges 22, 24 of adjoining strip 12 sections at least partially overlap such that ribs 31, 31' and grooves 33, 33' are placed in a facing orientation, and can be cooperatively interlocked to define a hollow sleeve in which gripping end 14 is received. In this fashion, the adherence of side edges 22, 24 promoted by the adhesive is significantly reinforced.

When elongated strip 12 is wrapped around gripping end 14, top face bevels 40, 40' are placed in an adjacent orientation and define grooves 42 in the completed grip 10 (FIG. 3). Grooves 42 allow airflow and channeling of moisture between the user's palm and the grip 10 of the present invention. Elongated strip bevel 38 provides a flush mount with the outer surface of gripping end 14, promoting a more attractive and streamlined appearance. Tape or the like may be used to enhance the adherence of bevel 38 to gripping end 14.

Any material having the desired properties of durability, cushioning, and tackiness required for a slip-resistant grip may be used in fabricating elongated strip 12, such as polymers (for example polystyrene or polyurethane), latex, rubber, natural or synthetic leather, or any other material currently used in fabricating grips for sports equipment. The thickness of strip 12 may be varied in accordance with the needs of the user, i.e. in accordance with the user's hand size and preferred grip thickness.

Accordingly, the present invention provides a strip or ribbon-style grip wherein the securement of adjoining strip side edges 22, 24 is enhanced. In this fashion, inadvertent slippage or unwrapping of the elongated strip 12 due to use and wear and tear on the adhesive is reduced. The need for replacement due to such wear and tear is similarly reduced. The strip or ribbon-style grip of the present invention may be used alone as the grip for an article of sporting equipment such as a golf club or tennis racket, or may be used as a component of a grip system. For example, the strip or ribbon-style grip may be fabricated of a suitable substantially transparent material, and may be used as a covering for a grip to protect a design placed on the grip while still allowing visualization of the design. Such a system is described in co-pending U.S. Pat. No. 6,718,675 for Display Grip for Sports Equipment, the entirety of which is incorporated herein by reference.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, an end cap 44 may used to secure elongated strip 12 to the distal portion of gripping end 14 (see FIGS. 2–4), either before or after the grip 10 of the present invention is installed thereon, using a combination of adhesive and a friction fit as is known in the art. A rib and groove structure as is described in the present inventor's U.S. Pat. No. 6,718,675 may also be used to secure elongated strip 12 to end cap 44.

The embodiment described was chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A grip for sporting equipment having a gripping end, comprising:

an elongated strip adapted for wrapping the gripping end; and a rib and groove structure disposed on the elongated strip;

whereby wrapping the elongated strip around the gripping end allows cooperative interlocking of adjoining sides of the elongated strip such that the elongated strip defines a hollow sleeve adapted to receive the gripping end in an interior thereof.

2. A grip for sporting equipment having a gripping end, comprising:

an elongated strip adapted for wrapping the gripping end, and having a first side edge, a second side edge, a top edge, and a bottom edge;

a first cooperating rib and groove structure disposed on the first side edge; and a second cooperating rib and groove structure disposed on the second side edge;

whereby wrapping the elongated strip around the gripping end at least partially overlaps the first and second rib and groove structures for cooperative interlocking thereof to secure the first side edge to the adjoining second side edge and to define a hollow sleeve adapted to receive the gripping end in an interior thereof.

3. The grip of claim 2, wherein the elongated strip first edge is substantially parallel to the second edge.

4. The grip of claim 3, wherein the elongated strip bottom edge terminates in a bevel.

5. A grip for sporting equipment having a gripping end, comprising:

an elongated strip adapted for wrapping the gripping end and having a top edge, a bottom edge, first and second side edges, a top face, and a bottom face opposed to the top face;

a first rib and groove structure disposed on the first side edge and oriented towards the bottom face; and a second rib and groove structure disposed on the second side edge and oriented towards the top face;

whereby wrapping the elongated strip around the gripping end places the first and second rib and groove structures in a partially overlapped and facing orientation for cooperative interlocking thereof to secure the first side edge to the adjoining second side edge, defining a hollow sleeve adapted to receive the gripping end in an interior thereof.

6. The grip of claim 5, wherein the elongated strip first side edge is substantially parallel to the second side edge.

7. The grip of claim 5, wherein the elongated strip bottom edge terminates in a bevel.

8. The grip of claim 5, wherein the elongated strip top face edge includes a bevel such that wrapping the gripping end with the elongated strip defines a groove between adjacent first and second side edges.

* * * * *